United States Patent [19]
Deisenroth

[11] 4,405,534
[45] Sep. 20, 1983

[54] PRODUCTION OF PLASTIC-BONDED EXPLOSIVE SUBSTANCES

[76] Inventor: Friedrich-Ulf Deisenroth, Fichtenweg 1, 8899 Rettenbach, Fed. Rep. of Germany

[21] Appl. No.: 240,909

[22] Filed: Mar. 5, 1981

[30] Foreign Application Priority Data

Mar. 15, 1980 [DE] Fed. Rep. of Germany ..... 3010052

[51] Int. Cl.³ ..... C06B 21/00
[52] U.S. Cl. ..... 264/3 C; 149/2; 149/7; 149/9; 149/19.4; 149/19.92; 264/3 R; 264/3 D
[58] Field of Search ..... 102/292; 149/2, 6, 7, 149/9, 19.4, 19.92; 264/3 R, 3 C, 3 D, 3 E

[56] References Cited

U.S. PATENT DOCUMENTS 3,736,194 5/1973 Heller ..... 149/19.92
4,214,927 7/1980 Inoue et al. ..... 264/3 C
4,293,352 10/1981 Lee et al. ..... 149/19.92

FOREIGN PATENT DOCUMENTS 2345070 4/1974 Fed. Rep. of Germany ..... 264/3 C

*Primary Examiner*—Leland A. Sebastian
*Attorney, Agent, or Firm*—Murray Schaffer

[57] ABSTRACT

A process for the production of plastic-bonded explosive substances wherein the binder is applied from aqueous dispersion is characterized in that polyurethanes applied in the absence of organic solvents are used as binder and in that the granulates obtained are dried and then compressed. Explosive substances obtained by the process are also provided.

12 Claims, No Drawings

PRODUCTION OF PLASTIC-BONDED EXPLOSIVE SUBSTANCES

This invention relates to a process for the production of plastic-bonded explosive substances of crystalline explosives and/or crystalline inorganic oxidizers, energy-generating additives and a polyurethane binder applied from aqueous dispersion without the use of organic solvents, and to the explosive substances obtained by this process.

It is known, for example from German Offenlegungsschrift No. 2,709,949, that polyurethanes can be used in plastic-bonded explosive substances. The advantage of polyurethanes is that, in addition to good mechanical properties, they impart above-average resistance to shock and impact and minimal mechanical sensitivity to the explosive substances. Thus, explosive substances containing from 2.5 to 10% of polyurethane are described for example in the Encyclopedia of Explosives and Related Items.

In the known process, the crystalline explosive substances are minerally mixed with the polyurethane binder by the slurry technique in which the polyurethane binder is dissolved in a solvent and the resulting solution is added to an aqueous dispersion of the explosive substance provided with protective colloids. By applying a complicated process, in which the solvent is distilled off from the mixture, it is possible to produce granulate in the required size.

However, processes are also known in which the polyurethane binder is applied using the dry explosive with the sole assistance of organic solvents. In this case, too, the solvent is distilled off until granulates are formed. The polyurethanes used in these known processes are solid polymers of relatively high molecular weight, the binding process being physical, i.e. no reaction takes place.

The reactive processes are known to start with liquid, hydroxy-terminated polyesters, ethers and butadienes which are crosslinked with isocyanates. The latter process is predominantly used when it is desired to obtain pourable mixtures of explosive substances.

Between the slurry process and the reactive process there are a variety of different intermediate stages. The disadvantage of the slurry process in the described versions, apart from the use of organic solvents, is that it is difficult and expensive to carry out both technically and in terms of energy consumption. In addition, the recovery of large quantities of solvents is problematical. In the reactive processes, binder contents of less than 6% are difficult to disperse. Added to this is the disadvantage of having to operate under strictly anhydrous conditions to avoid any porosity in the explosive substance.

U.S. Pat. No. 3,173,817 describes explosive substances which are produced from aqueous dispersion using a polyacrylate. In this case, the plastics dispersion is coagulated by the addition of inorganic salts and the explosive granulates formed are mechanically separated from the water and dried.

The advantage of solvent-free processing is offset by the disadvantage of the poor thermal stability of the acrylates and the danger of inorganic coagulating agents being included to the detriment of the stability of the explosive. In addition, reproducible granulate formation, i.e. the production of a defined granulate, for compression-molding purposes is very difficult.

In the same way as the known polyurethane-bond explosive substances from the slurry process, the granulates have to be compression-molded under heat to ensure that the pressing obtained has the desired properties. However, compression-molding under heat is technically difficult and expensive.

Accordingly, the object of the present invention is to provide a process for the production of plastic-bonded explosive substances in which the disadvantages referred to above do not arise. More particularly, the object of the invention is to provide a process in which 1. polyurethane binders are used,
2. the explosive substances are produced from aqueous dispersions without any need to use organic solvents,
3. the granulates obtained in the process can be cold-pressed and extruded,
4. both processes may be varied and explosive substances differing in their properties may be obtained.

Accordingly, the present invention relates to a process for the production of plastics-bonded explosives, the binder being applied from aqueous dispersions, characterised in that polyurethanes applied in the absence of organic solvents are used as binder and the granulates obtained are dried.

According to the invention, novel, aqueous aliphatic and/or aromatic polyurethane dispersions having a solids content of from 30 to 40% are used. Polyurethane dispersions of this type are commercially available. They have particle sizes in the range from 0.1 to 0.4 $\mu$m and specific gravities of the order of 0.9 to 1.2, preferably 1.1. The pH-value of these dispersions may vary and is generally in the range from 5 to 8. However, the pH-value of the polyurethane dispersions depends upon their production and is of no significance to the process according to the invention. Transparent, approximately 0.1 to 0.2 mm thick films produced from commercially available aqueous dispersions of this type have breaking elongations, as determined in accordance with DIN 53504, of more than 500% and in addition show high tensile strengths.

Aqueous polyurethane dispersions of this type dry irreversible to form highly elastic films which adhere excellently to the crystals of explosives. The thermal stability and compatibility with blasting explosives of the polymers according to the invention is comparable with that of hitherto used polyurethanes so that the advantages of the polyurethanes may be exploited without being offset by the disadvantages of complicated processing.

The blasting explosives obtained with the polymers according to the invention may be cold-pressed very effectively under pressures of less than 2000 bars. If necessary, the mechanical properties of the polymers may readily be adjusted by using high-polymer, water-soluble plasticizers or reinforcing resins which may be dissolved in the water of the dispersion in accordance with the invention, forming a film with the polyurethane.

Polymeric plasticizers are used because the migration phenomena of the plasticizer observed in the case of polymers plasticized with low molecular weight plasticizers have to be avoided.

The plasticizers used in accordance with the invention are, for example, polyethylene glycols, polypropylene glycols, polyvinyl pyrrolidone and polyvinyl methyl ether, but preferably polyethylene glycols having a molecular weight of at least 5000, which although soluble in water are not hygroscopic, and polyvinylethers. Water-soluble reinforcing resins are epoxide resins such as 3,4-epoxycyclohexyl methyl- and 3,4-epoxycyclohexane carboxylate and the reaction product of pentaerythritol and epichlorhydrin, polymethoxy melamines, polyethylene/maleic acid anhydride copolymers, polyacrylamide and phenolic resins. The reinforcing resins work in different ways. Whereas the epoxide resins are hardened with a water-soluble hardener parallel to the physical drying and film-forming process of the polyurethane, the polyethylene/maleic acid anhydride copolymer films together with the polyurethane to form films characterised by increased mechanical strength.

The polymethoxy melamines, phenolic resins and the polyacrylamide are dissolved in the dispersion, but change at the temperatures prevailing in the process during drying in the range from 40° to 50° C. into soluble, crosslinked products which produce an increase in strength.

Table I shows both some plasticizers and also reinforcing resins and their effect on one of the polyurethane dispersions according to the invention.

TABLE I

| | Substance | Proportion in the binder (%) | Tensile strength ($N/mm^2$)* | Breaking elongation (%) |
|---|---|---|---|---|
| 1. | Polyurethane binder from dispersion | 100 | 40 | 300 |
| 2. | Polyethylene glycol 20,000 | 5 | 27.5 | 600 |
| 3. | Polyethylene glycol 20,000 | 10 | 11 | 720 |
| 4. | Polyvinyl methyl ether | 15 | 34 | 520 |
| 5. | 3,4-epoxycyclohexylmethyl and 3,4-epoxycyclohexane carboxylate + polyolsilane hardener | 5 | 59 | 350 |
| 6. | Polyacrylamide | 10 | 68 | 220 |
| 7. | Polymethoxy melamine | 15 | 84 | 200 |

*as measured on films 0.1 mm thick

It has been found that the proportion of plasticizer in the binder should amount to between 0 and 30% and preferably to between 5 and 15% and that, within these limits, it is possible to produce extrudable, elastoplastic explosive compositions. The proportion of reinforcing resin is determined above all by its compatibility with the polyurethane and by its solubility in water. It should amount to between 0 and 50% and preferably to between 2 and 20%.

Crystalline explosives which may be processed with the binder according to the invention must above all be insoluble in water. Accordingly, it is possible to use any crystalline, water-insoluble primary and secondary blasting explosives such as, for example RDX, HMX, nitroguanidine, potassium and guanidine picrate, tetryl, diamino- and triaminotrinitrobenzene, benzotrifuroxane, diaminohexanitrobiphenyl, hexanitrostilbene and pentaerythritol tetranitrate, this list being by no means complete.

In the process according to the invention, the proportion of crystalline explosive in the composition as a whole may amount to between 50 and 99.8%, i.e. even the smallest quantities of binder may be applied without difficulty.

The explosive substances according to the invention may be produced by two methods. Either the aqueous polyurethane dispersion is initially introduced with the plasticizers or reinforcing resins and the water-moist explosive substance is mixed in using a suitable mixer. This process is suitable for binder contents of up to 8%, the water content being controlled by the addition of water where the binder content is smaller. The moist explosive composition may then be safely granulated and dried. This process is known per se. With higher binder contents, the mass becomes so pasty that mechanical granulation is impossible. In this case, a dispersion of the binder and blasting explosive is prepared in a relatively large quantity of water and the binder is coagulated. Granulates are formed, being separated from the water and dried.

According to the invention, coagulation is carried out with the polyvinylmethyether already described as plasticizer to avoid contamination by inorganic salts. This material has the property of precipitating from the aqueous solution in finely divided form on heating and thus breaking the polyurethane dispersion.

Another possible method according to the invention of coagulating the binder is to add the phenolic resins described as reinforcing resins. In this case, the coagulation time may be precisely set through the proportion of phenolic resin, thus enabling controlled granulate formation to be obtained. It is a particular advantage that the grain size of the crystalline explosive substances and additives is not critical. Thus, nitroguanidine for example with a grain size of from 1 to 2 μm may readily be processed into compression-moldable granulate so that there is no need to use expensively recrystallised nitroguanidine.

However, the main advantage of the process according to the invention lies in the fact that it is easy to carry out using simple machinery, safety being guaranteed by the fact that processing is carried out in the aqueous phase.

Another very considerable advantage lies in the very good cold-pressability of the granulates which may be controlled through the proportion of plasticizer. Thus, it is possible to produce elastomeric pressings in the pressure range from 800 to 2500 bars with the same binder content, but with a different plasticiser content.

One advantage over the equally cold-pressable explosive substances containing liquid two-component polyurethanes is that there are no pot lives to be observed nor any thermal after-treatments required for hardening, in addition to which the granulated blasting explosive may be indefinitely stored. By virtue of the good flow properties of the binder, the duty times of the presses may be kept short, i.e. of the order of 2 to 3 s.

Finally, a major advantage is that the mechanical properties of the charges produced from the explosive substances according to the invention may be adapted to meet particular requirements—for the same performance data—by modifying the binder in the manner described.

It is obvious that the process is not limited to the production of the described binder/explosive mixtures, instead explosive substances may also be produced from the binder according to the invention, organic crystalline explosives and inorganic salts as well as energy-generating metal powders. These salts known per se may be perchlorates, such as potassium perchlorate, nitrates, such as barium nitrate, heavy metal oxides, such as lead, iron and copper oxides. Metal powders may be aluminum, aluminum-magnesium alloys, silicon, titanium, zirconium and tungsten. Finally, it is also obvious that the explosive substances according to the invention may also be used as porpellent charge powders instead of conventional nitrocellulose powders.

In this connection, it is a considerable advantage that the binder may be formulated in such a way that the mixtures may be extruded cold or at moderately elevated temperature and no solvents are required.

The invention is illustrated but in no way limited by the following Examples.

EXAMPLE 1

142.5 g of an aqueous polyurethane dispersion, 3 g of polyethylene glycol (molecular weight 20,000) and 1034 g of RDX (average grain size 60 μm, 10% water) were mixed for 15 minutes in a vertical kneader. The most friable mass was passed through a mechanical granulator. The granulates obtained were dried for 24 h at 50° C. Thereafter the blasting explosive had a water content of 0.1%.

EXAMPLE 2

The granulates of Example 1 were compression-molded at 20° C. under pressures of 1500, 2000 and 2500 bars to form pressings 30 mm in diameter. The densities of the resulting pressings amounted to 1.68, 1.71 and 1.735 g/cc (98% of the theoretical density).

EXAMPLE 3

The granulates of Example 1 were subjected to a stability test at 120° C. (amount weighed in 2.5 g).

| Time (h) | Evolution of gas ml/2.5 g |
|---|---|
| 2 | 0.2 |
| 4 | 0.25 |
| 6 | 0.25 |
| 8 | 0.3 |
| 10 | 0.3 |
| 20 | 0.3 |

The blasting explosive shows high thermal stability.

EXAMPLE 4

The detonation rate of pressings obtained in accordance with Example 3 was measured. A value of 8360 +40/−20 m/sec was obtained for a density of 1.735 g/cc.

EXAMPLE 5

A nitroguanidine having an average grain size of 1.8 μm was processed in accordance with Example 1. On account of its poor bulk density, the nitroguanidine was mixed in three portions and 6% of water (based on the total quantity) was additionally introduced.

The mass obtained granulated excellently. At 1.6 g/cc, the the pressing density of the blasting explosive reached at 2000 bars amounted to 95% of the theoretical.

EXAMPLE 6

800 g of RDX, 150 g of aluminium (92% metal) and 125 g (5%) of an aqueous polyurethane dispersion were suspended in a stirrer-equipped vessel. After the addition of 20 g of a 50% phenolic resin/formaldehyde condensate, the dispersion coagulated in 60 s. Granulates varying from 3 to 4 mm in diameter were formed. After drying, the granulate could be pressed at 2500 bars/20° C. into pressings having a density of 1.86 g/cc.

EXAMPLE 7

A suspension of 820 g of RDX, 18 g of PEG 20,000 and 405 g (16.2%) of the aqueous polyurethane dispersion according to the invention was prepared in accordance with Example 1. Following the addition of 50 g of a 10% aqueous solution of polyvinyl methyl ether, the temperature was raised to 45° C. The dispersion coagulated and granulates having a grain size of from 1 to 2 μm were formed. The dried, highly elastic granulates could be extruded at 50° C. into dimensionally stable shapes.

The compositions according to the invention may be used as smokeless propellants.

I claim:

1. A process for producing plastic bonded explosives consisting of the steps of providing a crystalline water insoluble explosive, and a fully reacted aqueous polyurethane dispersion substantially free of organic solvent, incorporating said explosive into said dispersion to form a uniform mixture thereof, coagulating said mixture to form granulates thereof, and drying said resultant granulates.

2. A process as claimed in claim 1, wherein said dried granulates are cold-pressed.

3. A process as claimed in claims 1 or 2, wherein said polyurethane binder dispersion includes 0 to 30%, based on said binder, of a water-soluble polymeric plasticizer.

4. A process as claimed in any of claims 1, 2 or 3, wherein said polyurethane binder dispersion includes 0 to 50% based on said binder, of a water-soluble monomeric or polymeric, thermally crosslinkable or film-forming reinforcing resin.

5. A process as claimed in claim 3, wherein said plasticizer comprises polyethylene glycols having a molecular weight of more than 5000.

6. A process as claimed in claim 3, wherein said plasticizer comprises polyvinyl methyl ether having a molecular weight of from 5000 to 10,000.

7. A process as claimed in claim 3, wherein said plasticizer is used in a quantity of from 5 to 15%, based on said binder.

8. A process as claimed in any one of claims 3 or 6, wherein said binder is coagulated with water-soluble polyvinyl methyl ether.

9. A process as claimed in any one of claims 1, 2, 3, 6 or 7, wherein the mixture of crystalline explosive and binder, is coagulated by heating and the granulates formed are separated from the water and dried.

10. A process as claimed in claim 4, wherein said reinforcing resin is selected from the group consisting of polyethylene/maleic acid anhydride copolymers and epoxide resins.

11. A process as claimed in claim 10, wherein said reinforcing resin is used in a quantity of from 2 to 20%, based on the binder.

12. A process as claimed in any one of claims 4, 9 or 10, wherein said binder is coagulated with phenol-formaldehyde resins.

* * * * *